US008146522B2

(12) United States Patent
Lee et al.

(10) Patent No.: US 8,146,522 B2
(45) Date of Patent: Apr. 3, 2012

(54) APPARATUS FOR FORWARD AND BACKWARD MOVEMENT OF SEWING MACHINE

(75) Inventors: Kyoo Kun Lee, Daegu (KR); Yong Kyun Jang, Daegu (KR)

(73) Assignees: Dae Hung Precision Co., Ltd., Daegu (KR); Yong Kyun Jang, Daegu (KR)

( * ) Notice: Subject to any disclaimer, the term of this patent is extended or adjusted under 35 U.S.C. 154(b) by 335 days.

(21) Appl. No.: 12/607,953

(22) Filed: Oct. 28, 2009

(65) Prior Publication Data

US 2010/0229771 A1 Sep. 16, 2010

(30) Foreign Application Priority Data

Mar. 11, 2009 (KR) ..... 10-2009-0020535

(51) Int. Cl.
*D05B 11/00* (2006.01)
*D05B 69/10* (2006.01)

(52) U.S. Cl. ..... 112/470.12; 112/117; 112/220

(58) Field of Classification Search ..... 112/117–119, 112/102, 470.12, 470.13, 220, 271; 474/1, 474/87, 88, 149, 152
See application file for complete search history.

(56) References Cited

U.S. PATENT DOCUMENTS 682,666 A * 9/1901 Brown ..... 212/89
3,854,467 A * 12/1974 Hofmeister ..... 124/25.6
4,327,653 A * 5/1982 Blessing ..... 112/470.12
4,557,206 A * 12/1985 Iwase ..... 112/470.13
4,696,242 A * 9/1987 Scholl et al. ..... 112/470.13
5,287,820 A * 2/1994 Stutznacker ..... 112/117
5,913,275 A 6/1999 Flynn
7,143,705 B2 * 12/2006 Frazer et al. ..... 112/117
2002/0104468 A1 * 8/2002 Myers et al. ..... 112/117
2003/0188675 A1 10/2003 Valeriote et al.
2004/0256373 A1 * 12/2004 Irwin et al. ..... 219/243

* cited by examiner

*Primary Examiner* — Ismael Izaguirre

(74) *Attorney, Agent, or Firm* — Blakely, Sokoloff, Taylor & Zafman

(57) ABSTRACT

Forward and backward movement apparatus for main body of sewing machine according to this invention comprises, in sewing machine comprising Main Body movable forward and backward and supported on both sides of a Base and Heads movable left and right and supported on the Main Body; Frame mounted on the Base; Timing Gears installed in the front and rear Fixed Frame of the Frame in multiple rows; Connecting Shat which connects Timing Gears beneath Front Fixed Frame; Forward and Backward Movement Frames is movable forward and backward on the Frame and connected to the Main Body; Rollers are installed in the Forward and Backward Movement Frames in multiple rows to correspond to the Timing Gears; Timing Belt which zigzags through Timing Gear and Roller and Timing Gear and Roller, and both ends of which are connected to the top of Front and Rear Fixed Frames; and electric motor which drives the Connecting Shat in forward and reverse directions.

6 Claims, 18 Drawing Sheets

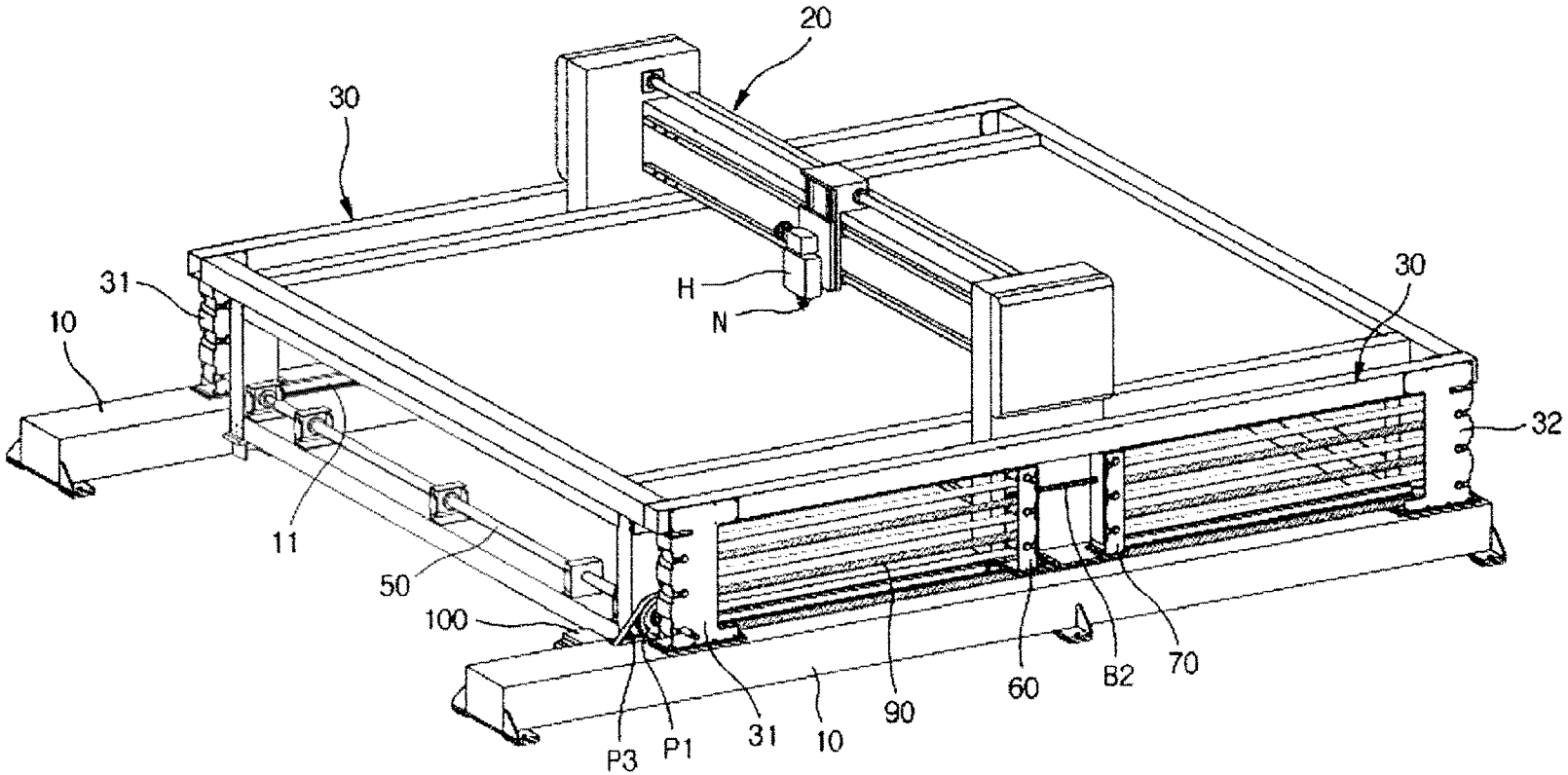
[Fig. 1]

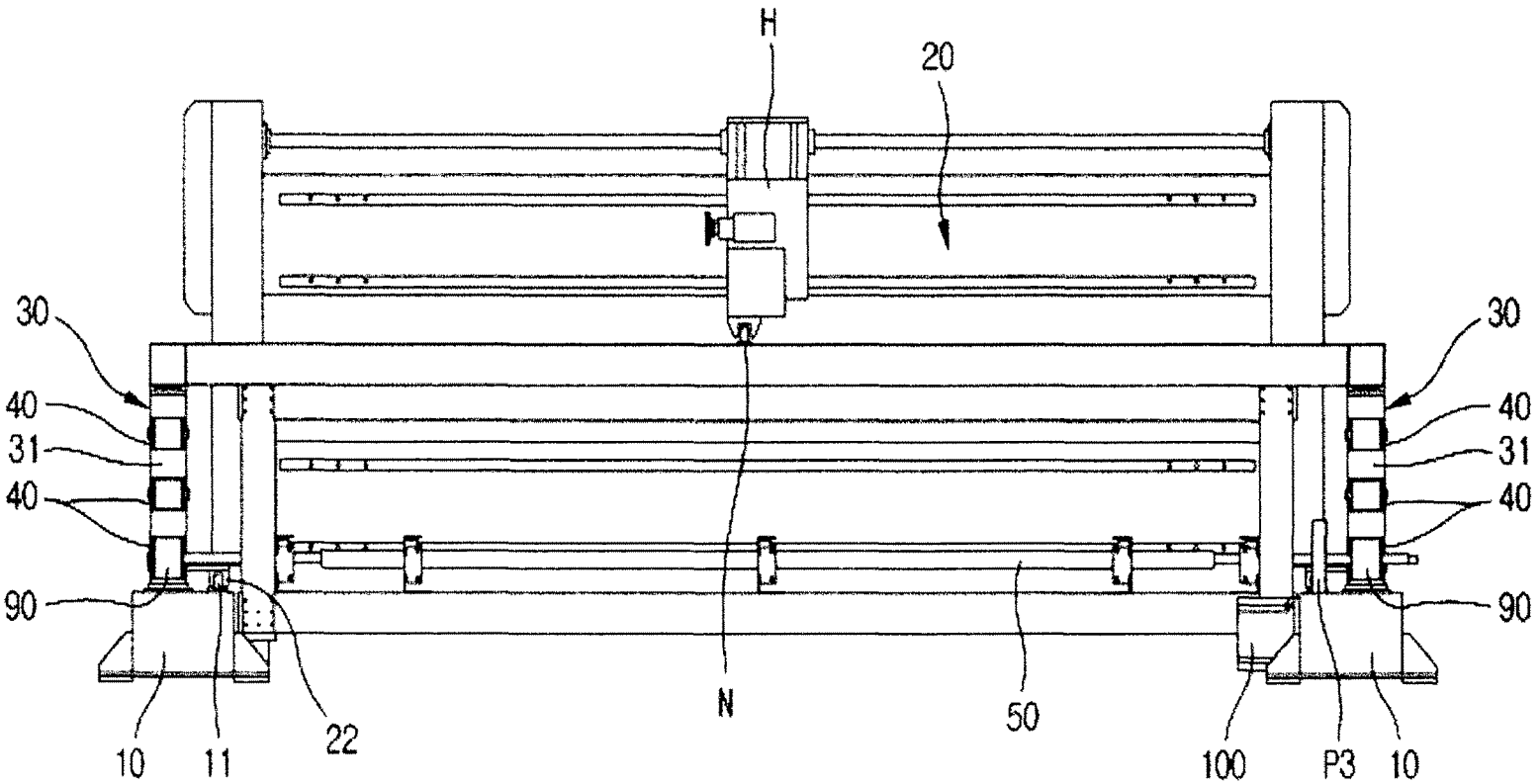
[Fig. 2]

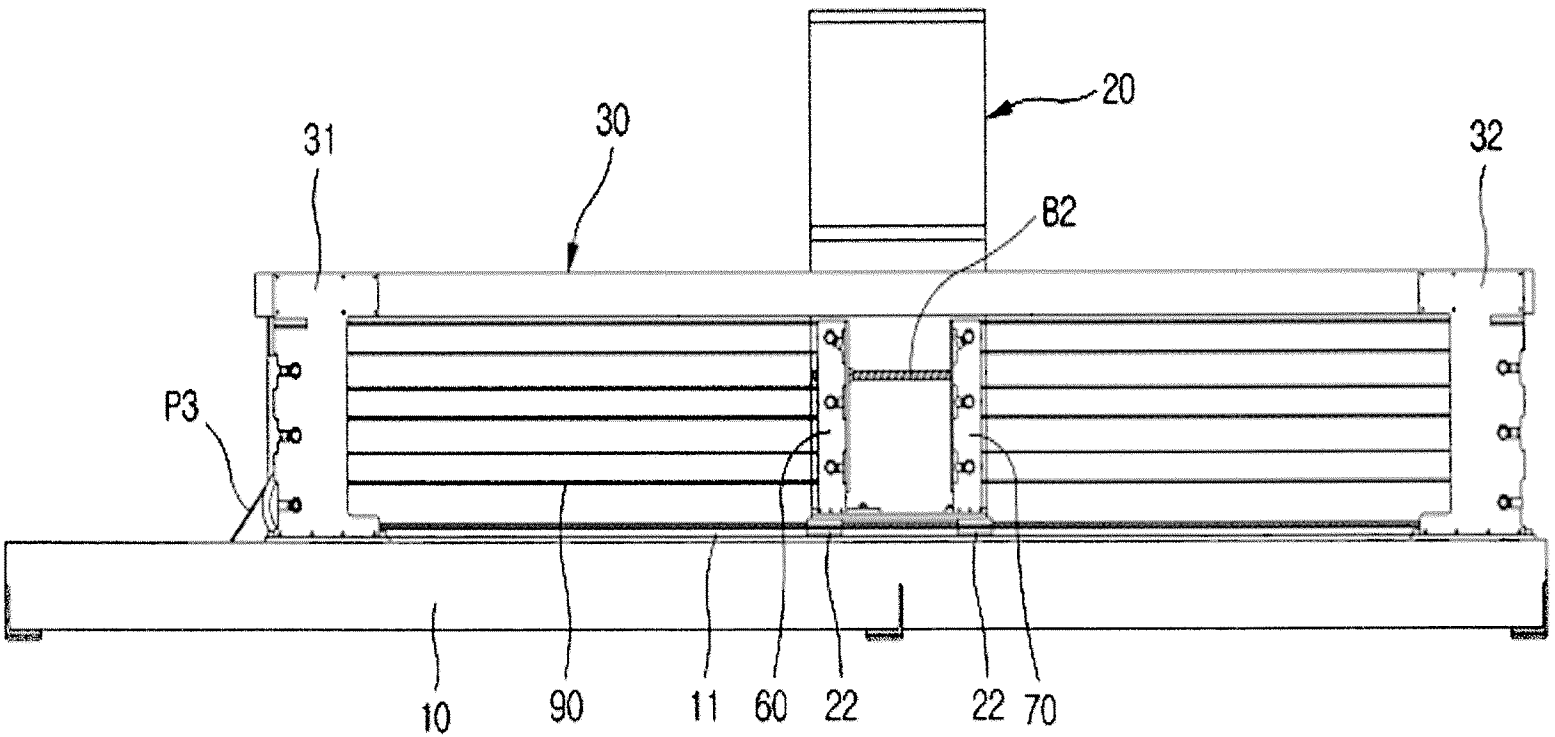
【Fig. 3】

【Fig. 4a】
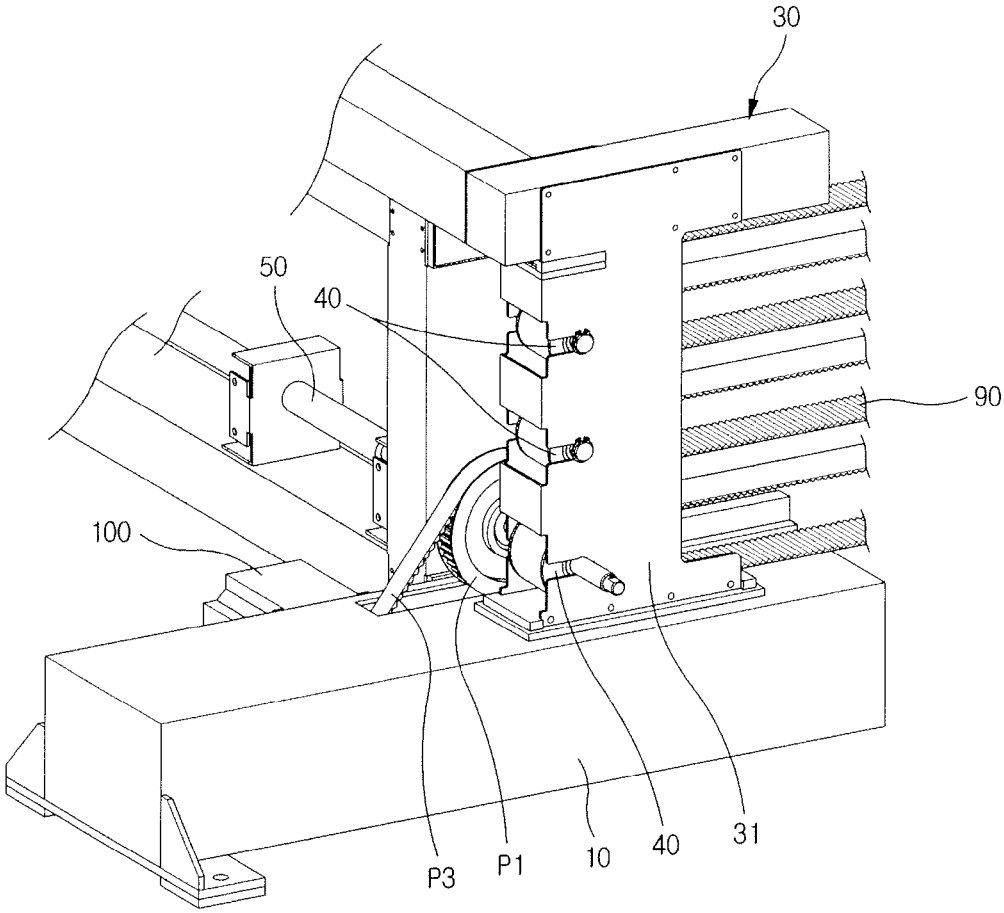

【Fig. 4b】
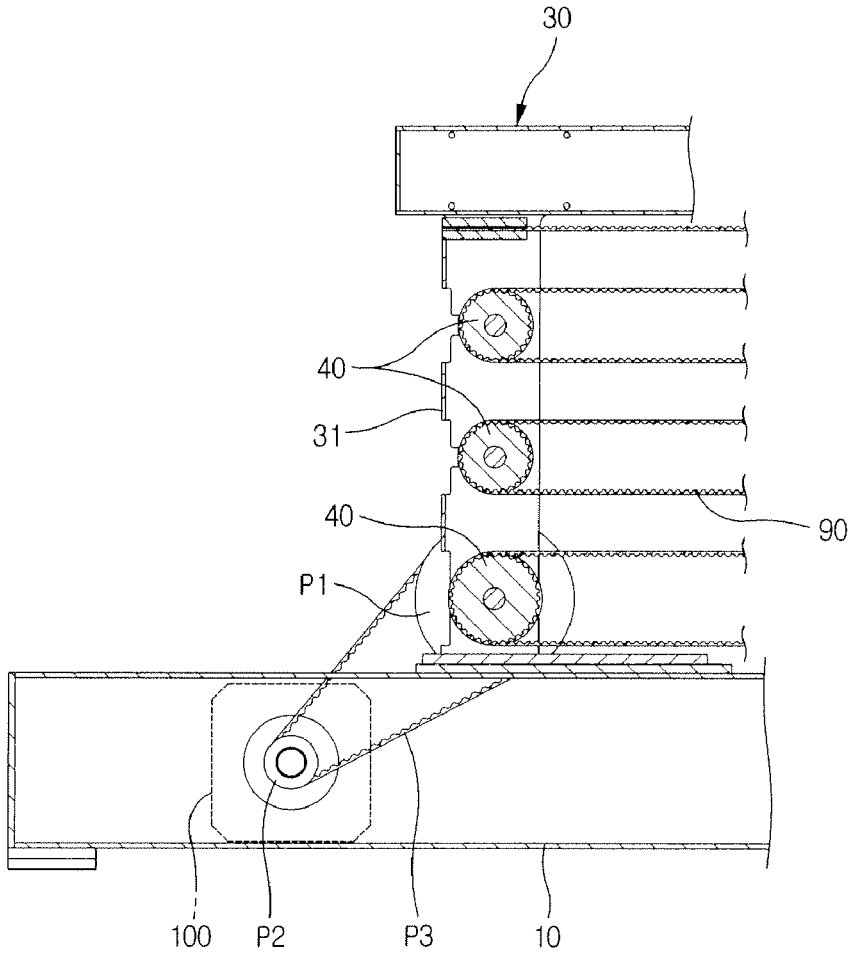

【Fig. 4c】
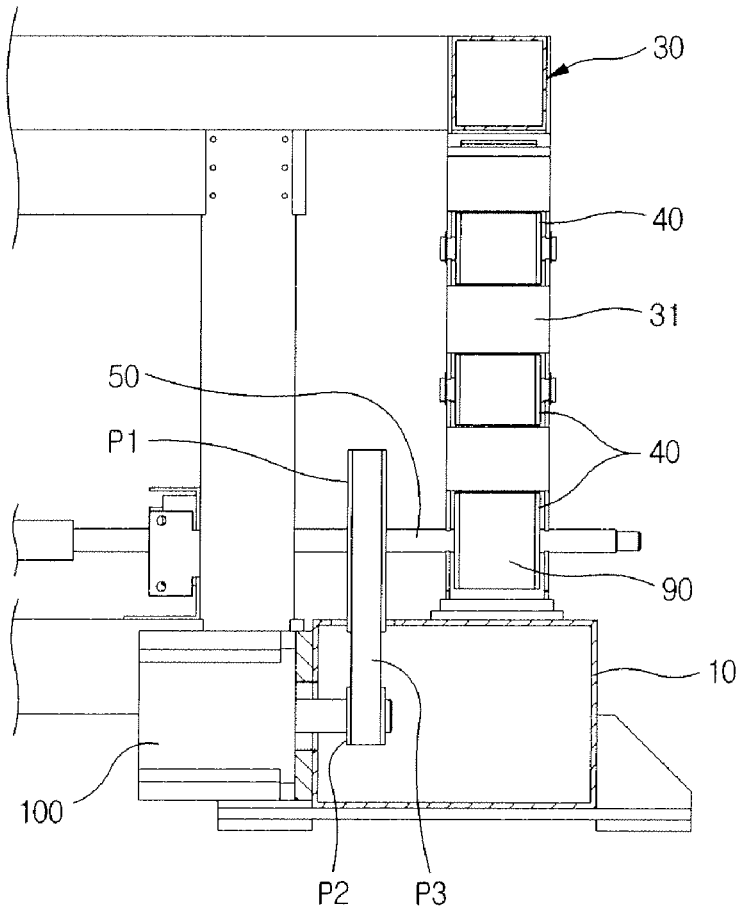

【Fig. 4d】
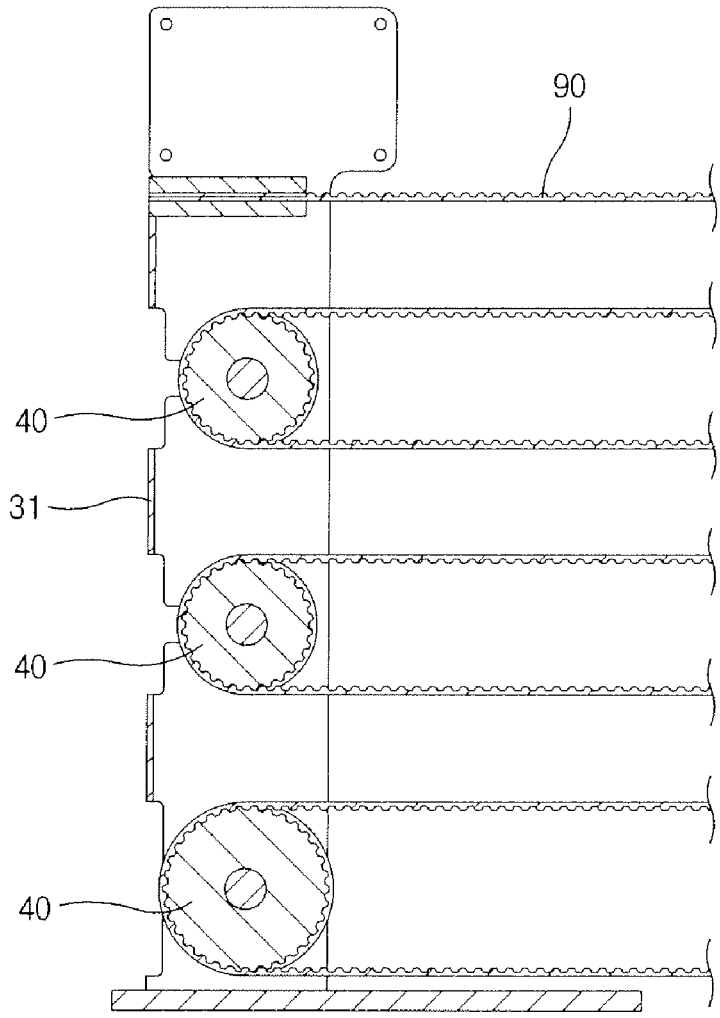

【Fig. 5a】
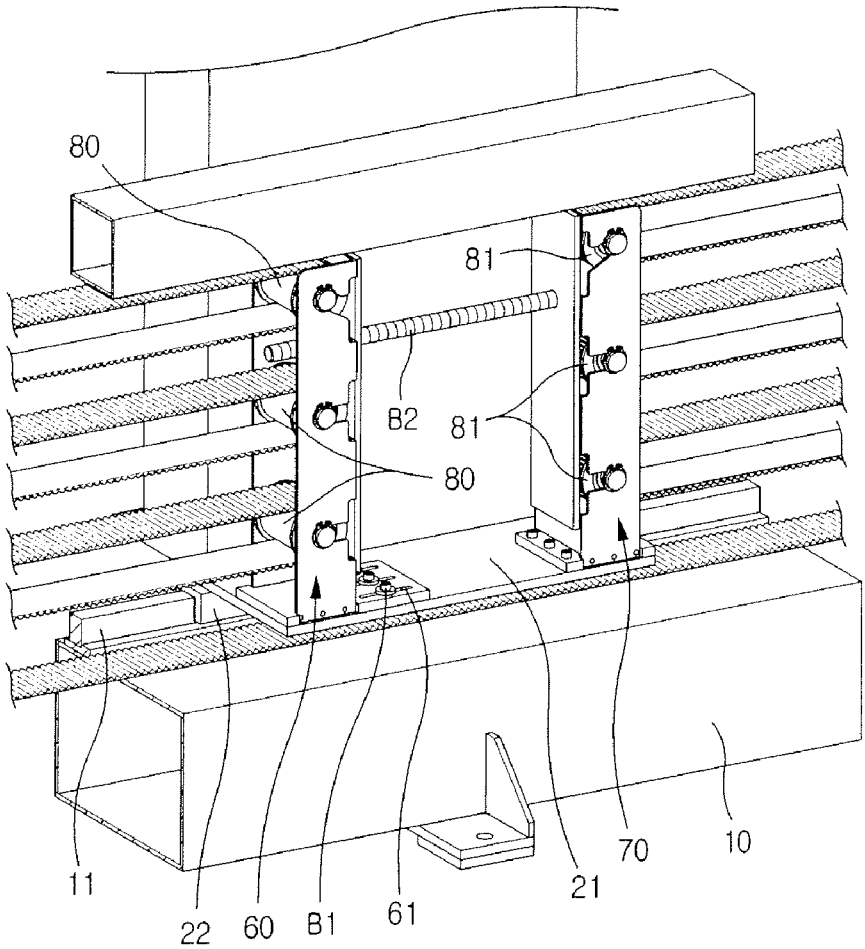

【Fig. 5b】
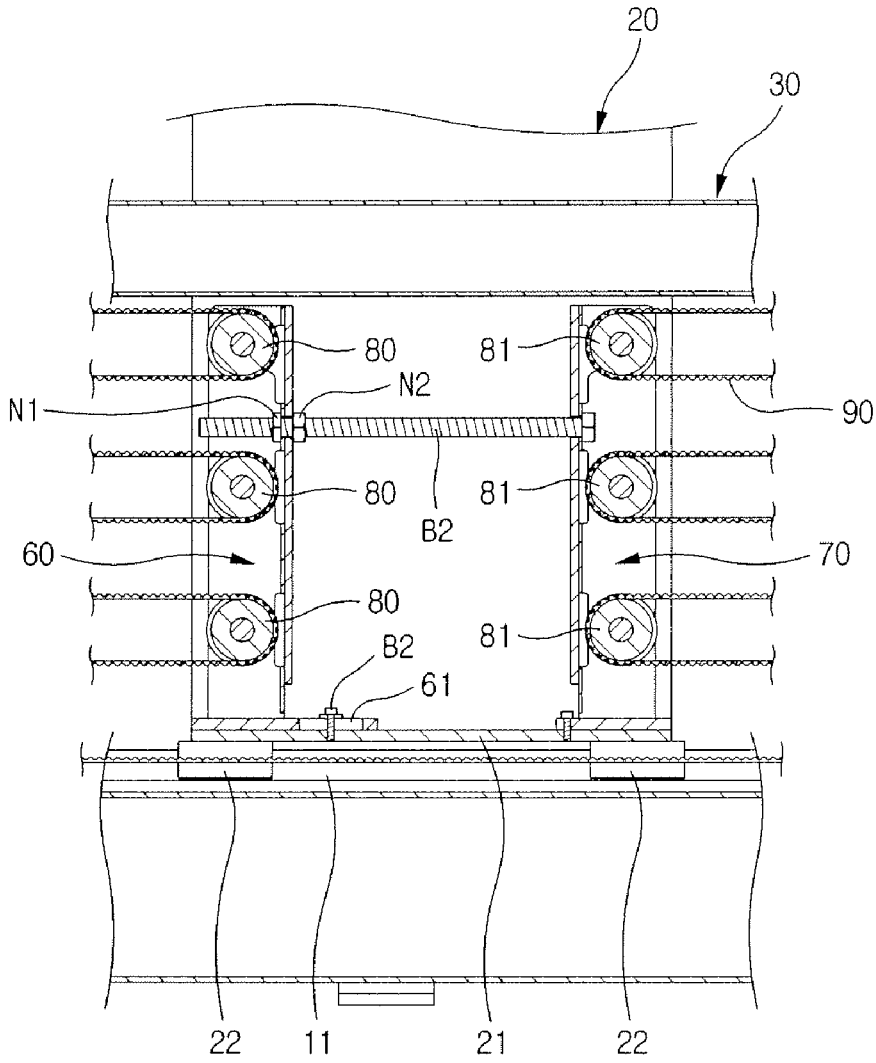

【Fig. 5c】
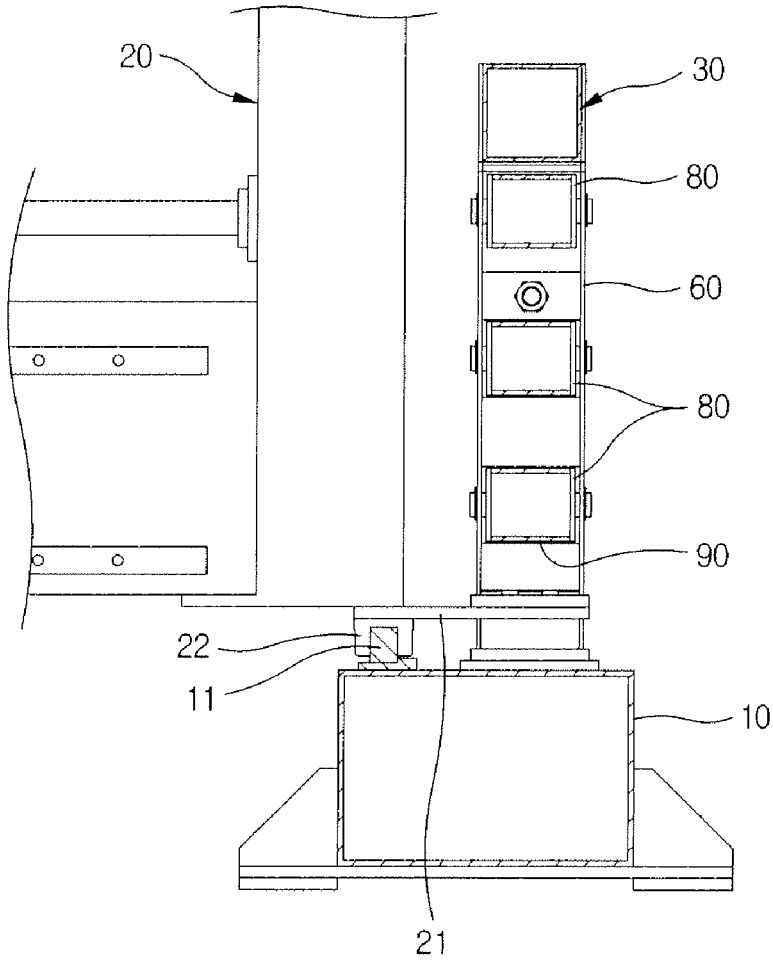

【Fig. 5d】
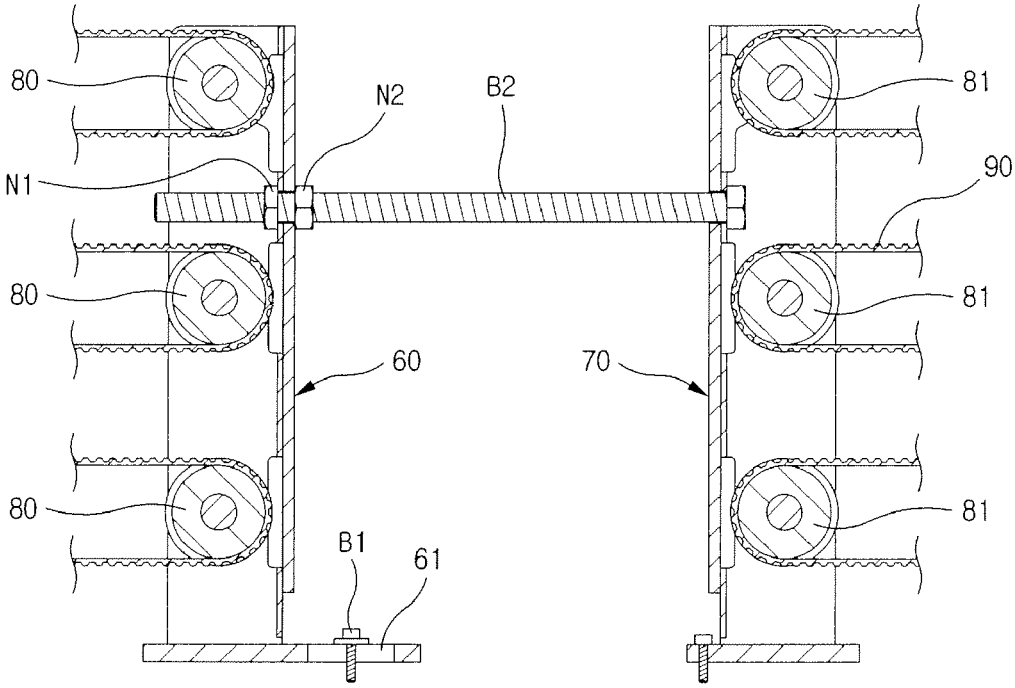

【Fig. 6a】
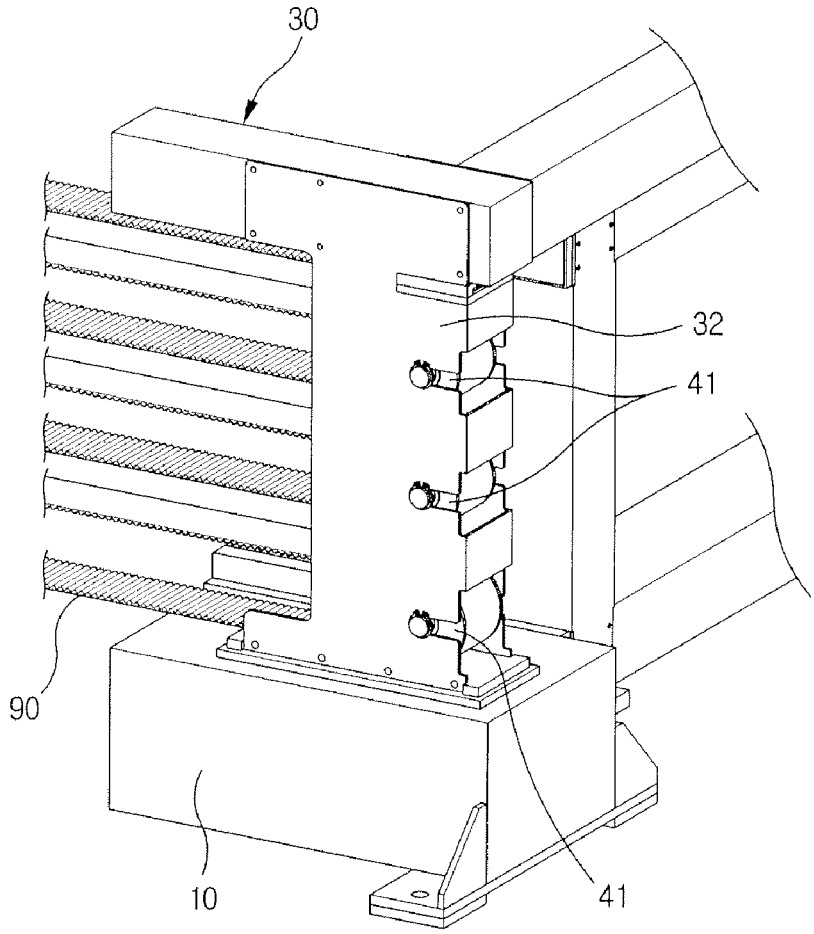

【Fig. 6b】
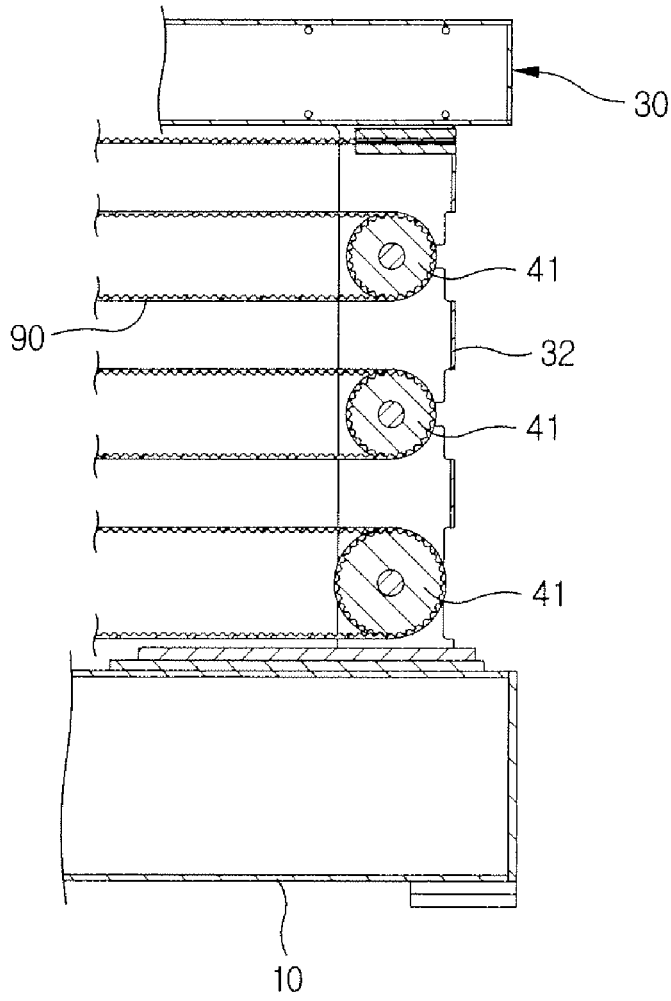

【Fig. 6c】
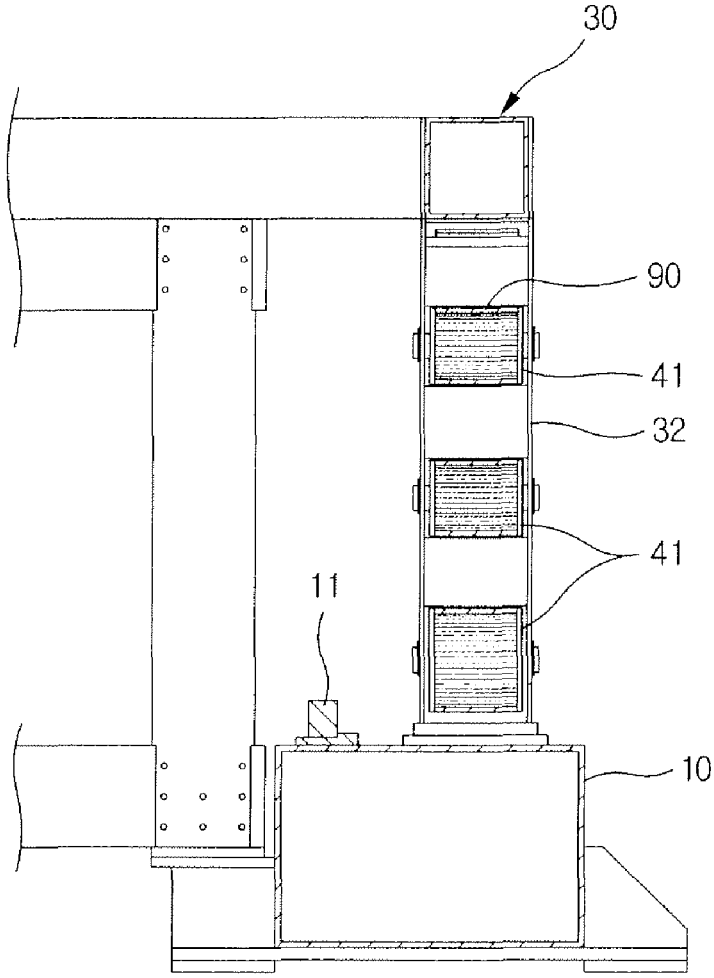

【Fig. 6d】
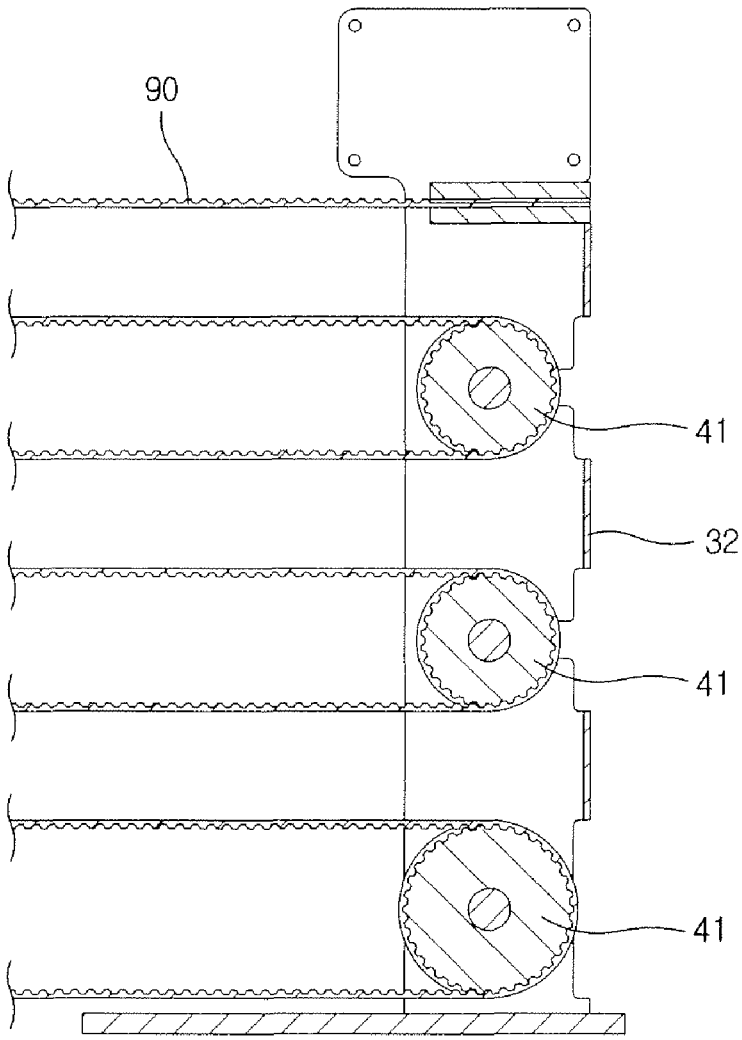

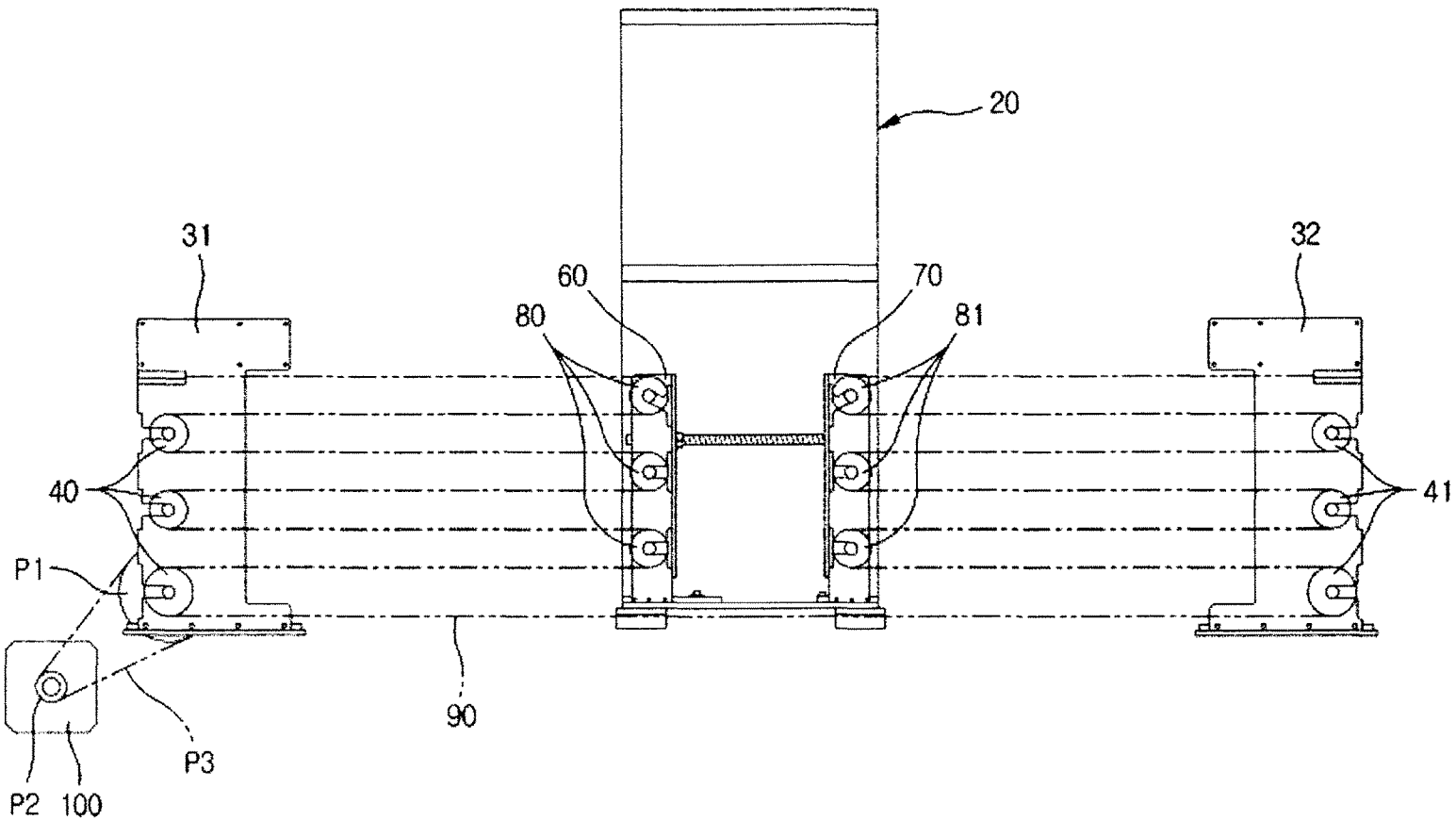
[Fig. 7a]

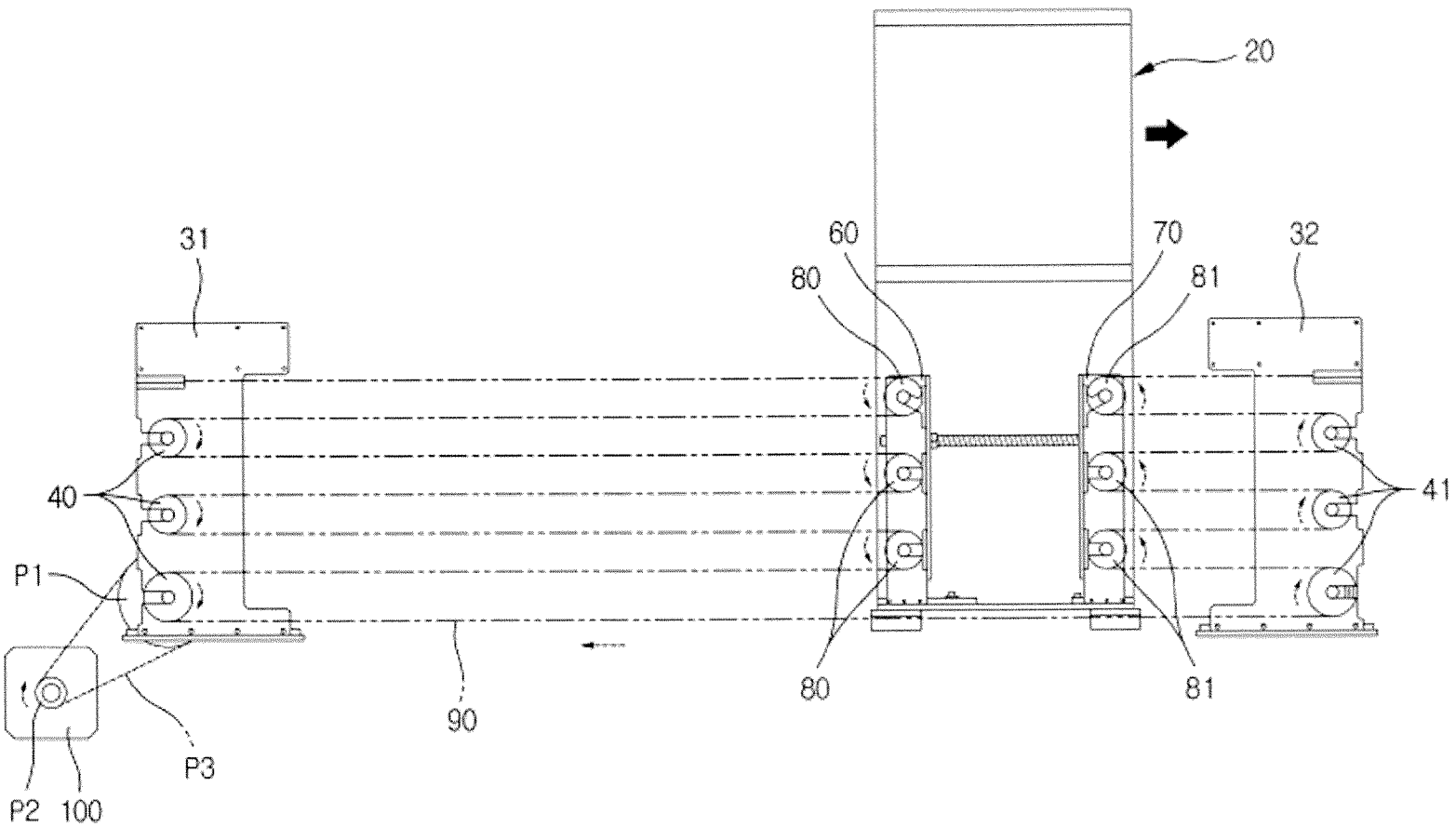
[Fig. 7b]

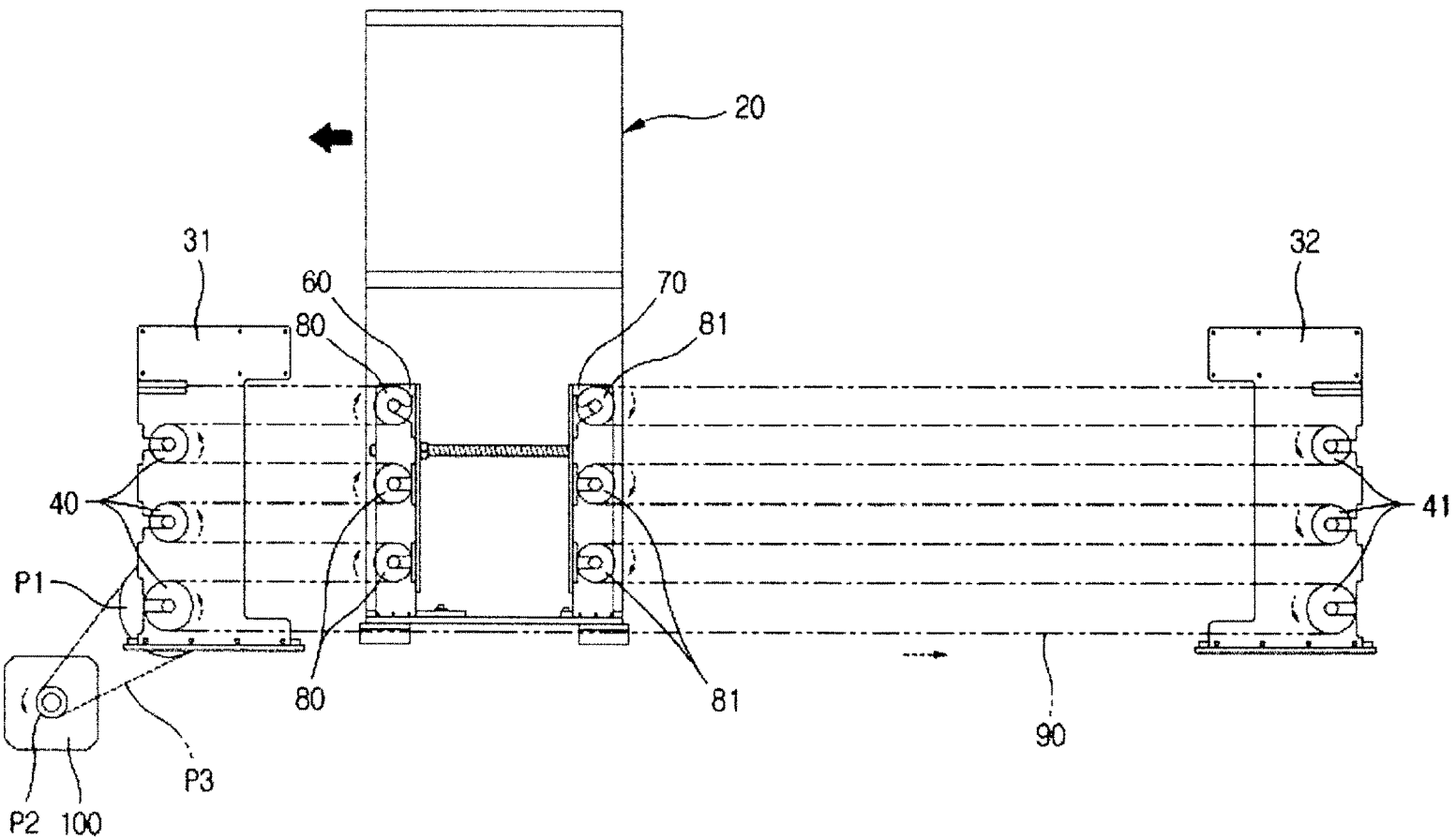
[Fig. 7c]

APPARATUS FOR FORWARD AND BACKWARD MOVEMENT OF SEWING MACHINE

BACKGROUND OF THE INVENTION

1. Field of the Invention

The present invention relates to a forward and backward drive apparatus of the main body of sewing machine, such as quilting machine, embroidery machine, etc., in particular, a forward and backward drive apparatus of the main body of sewing machine which enables accurate and smooth forward and backward movement of main body at high speed, improvement of productivity and quality, prevent machine parts damage caused by overload, and save operation cost.

2. Background of the Invention

In general, a sewing machine employs a main body movable in forward and backward on a base frame, a needle head movable in left and right on the main body, driving a sewing needle up and down, and a forward and backward drive for the main body.

The forward and backward drive for the main body that drives main body automatically is installed on both sides of the main body to drive the main body forward and backward to bring the needle in the head to desired position of cloth.

In conventional devices that drive main body forward and backward with screw and screw bearing mechanism, it has been difficult to move the main body to precise position at high speed due to relatively higher load.

Such difficulties result in low productivity and quality of products.

In addition, in the conventional devices, driving force is not distributed but concentrated at the screw bearing combined with the screw, leading to earlier wear and damage of the parts.

In addition, the screw and screw bearing are costly.

SUMMARY OF THE INVENTION

The present invention intends to solve above described problems of the conventional devices by providing the main bodies of sewing machines with a forward and backward drive apparatus which enables faster and more accurate movement, improvement of productivity and quality of products, prevent machine parts wear caused by concentrated force or overload, and cost saving.

In order to achieve the objects set forth hereinabove, the forward and backward movement apparatus in accordance with this invention, in the sewing machines which are substantially structured with a main body mounted on both sides of a base in such a way as to be movable forward and backward and a head, which is movable left and right, which drives a sewing needle up and down, comprises; a frame mounted on both sides of the base; two timing gears on both sides of the front and read fixed frame of the frame arranged in multiple rows allowing rotation; a connecting shaft which connects the two timing gears installed beneath the front fixed frames on both sides of the frame; a forward and backward movement frame mounted on both sides of the frame and connected to the main body; two rotatable, multi-row rollers installed at both sides of the forward and backward movement frame, corresponding to the timing gears; a timing belt which zigzags between the front timing gear and roller and the rear timing gear and roller, both ends of which are connected to the respective top of the front and rear fixed frame; and an electric motor which can rotate in forward and reverse directions.

The forward and backward drive apparatus using a timing belt for the main body of sewing machine in accordance with this invention provides the advantages including; substantially precise and smooth movement of main body at high speed; improvement of productivity and quality of products; prevention of machine parts damage caused by concentrated force, because the force is distributed by the timing belt; and cost saving by replacing costly screw drive mechanism with timing belt.

BRIEF DESCRIPTION OF THE DRAWINGS

FIG. 1 is a perspective view of the configuration of an exemplary embodiment in accordance with the present invention FIG. 2 is the front view of the FIG. 1.

FIG. 3 is a side view of the FIG. 1.

FIGS. 4(*a*), 4(*b*), 4(*c*), and 4(*d*) show an exemplary embodiment of the Front Fixed Frame in accordance with the present invention.

FIGS. 5(*a*), 5(*b*), 5(*c*), and 5(*d*) show an exemplary embodiment of the Backward Movement Frame in accordance with the present invention.

FIGS. 6(*a*), 6(*b*), 6(*c*), and 6(*d*) show an exemplary embodiment of the Rear Fixed Frame in accordance with the present invention.

FIGS. 7(*a*), 7(*b*), and 7(*c*) show an exemplary implementation of the drive chain in accordance with the present invention.

DETAILED DESCRIPTION OF THE INVENTION

The functions and their effects of the said members set forth and described hereinabove are described hereinbelow referring to the attached drawings.

As illustrated in the FIG. 1 to FIG. 7(*c*), the forward and backward drive apparatus in accordance with this invention, for the main bodies of the sewing machines comprising a Main Body(20) movable forward and backward and supported on both sides of a Base(10) and Heads(H) movable left and right and supported on the Main Body(20), is technically characterized by being comprised of; a Frame(30) mounted on both top surfaces of the Base(10); the rotatable Timing Gears(40)(41) installed in the front and rear Fixed Frames (31)(32) of the Frame(30) in multiple rows; a Connecting Shat(50) which connects the Timing Gears(40)(41) beneath the Front Fixed Frame(31); the Forward and Backward Movement Frame(60)(70) which is movable forward and backward on the Frame(30) and connected to the Main Body (20); the Rollers(80)(81) which are installed in the Forward and Backward Movement Frame(60)(70) in multiple rows to correspond to the Timing Gears(40)(41); a Timing Belt(90) which zigzags through the Timing Gear(40) and Roller(80) and Timing Gear(41) and Roller(81), and the both ends of which are connected to the top of the front and rear Fixed Frames(31)(32); and an electric motor(100) which drives the Connecting Shat(50) in forward and reverse directions.

Here, the said sewing machine is substantially designed to form various patterns on cloths by being consisted of, as shown in the FIG. 1, the Main Body(20) installed on both sides of Base(10), movable forward and backward, and a Head(H) installed beneath the said Main Body(20) to drive the needle(N) which embroiders patterns. Here, on the both top sides of the said Base(10) is mounted a Frame(30) by bolt joint, and the Forward and Backward Movement Frames(60) (70) are bolt jointed on the both bottom sides of the said main Body 920.

The Forward and Backward Drive apparatus in accordance with this invention is installed at both sides of the Main Body(20), one at one side, to drive the Main Body(20) forward and backward to position the needle(N) of the Head(H) to desired location.

On top of the said Base(10) which supports the Main Body (20) allowing forward and backward movement is formed with the Rails(11), as illustrated in the FIG. 5(*c*), on both sides, which guide the forward and backward movement of the Main Body(20).

The said Main Body(20) which supports left and right movement of the said Head(H) and moves the Head(H) forward and backward is installed with the Brackets(21), as shown in the FIG. 5(*c*), on the both bottom sides. The Brackets(21) are installed with the Sliders(22) on the both bottom sides, assembled with the said Rails(11) of the Base(10), and mounted with the Forward and Backward Movement Frame (60)(70) on its top. Here, the said Main Body(20) and the Backward Movement Frame(60)(70) moves forward and backward together.

On both sides of the front side of the said Frame(30) which is bolt jointed on top of the said Base(10) are installed with respective Front Fixed Frames(31) which support the rotatable, multi-row Timing Gears(40), and on both sides of the rear side of the said Frame(30) are installed with respective Rear Fixed Frames(32) which support rotatable, multi-row Timing Gears(41).

The said rotatable, multi-row Timing Gears(40)(41) which are installed on the Front and Rear Fixed Frames(31)(32) of the Frame(30) are driven with the zigzagged Timing Belt(90), as illustrated in the FIGS.(4*d*) and 6(*d*) and FIG. 7(*a*).

According to an exemplary embodiment, as illustrated in the FIGS.(4*d*) and 6(*d*), the said Timing Gears(40)(41) are provided in three rows, three belts on each side, whose teeth are engaged with the grooves of the said Timing Belt(90), and the first-row Timing Gears(40) at the lowest position on both sides are interconnected with the Connecting Shat(50), as shown in the FIG. 1 and FIG. 2. Consequently, when the said Connecting Shat(50) is driven, both first-row Timing Gears (40) at the bottom of both Front Fixed Frames(31) are driven together.

The said Connecting Shat(50) which connects the first-row Timing Gears(40) installed at the bottom of both Front Fixed Frame(31) is installed with a pulley(P1) driven by the Electric Motor(100). Therefore, when the said Connecting Shat(50) is driven, both first-row Timing Gears(40) at the bottom of both Front Fixed Frames(31) are driven together.

The said Forward and Backward Movement Frames(60) (70) which are mounted on both sides of the Frame(30) in such a was as to be able to move forward and backward and jointed with bolts with the brackets(21) on both sides of the Main Body(20), respectively, is installed with rotatable, multi-row Rollers(80)(81), respectively. Here, as the said Forward and Backward Movement Frames(60)(70) are jointed with the Main Body(20), the said Forward and Backward Movement Frames(60)(70) and the Main Body(20) moves forward and backward as an integral body.

According to an exemplary embodiment of the present invention, as illustrated in the FIG. 5(*a*) to FIG. 5(*d*), on the bottom of the said Forward Movement Frame(60) is provided with a member(61) with a long hole to allow position-adjustable bolt jointing(B1) with the Bracket(21) of the Main Body (20), the said Forward and Backward Movement Frames(60) (70) are installed with a tension-adjustment bolt(B2), and the said Forward Movement Frame(60) is provided with a fixed nut(N1) which is screw-jointed with the said tension-adjustment bolt(B2) which is tightened with a nut(N2). Therefore, position of the Forward Movement Frame(60) can be adjusted by loosening the bolt(B1) and tightening nut(N2) and tightening or loosening the tension-adjustment bolt(B2). Using the tension-adjustment bolt(B2) enables adjustment of the tension of the Timing Belt(90) to desired level. After adjusting tension, the bolt(B1) and tightening nut(N2) are tightened to fix the tension.

The said rotatable, multi-row Rollers(80)(81) on both Forward and Backward Movement Frames(60)(70), corresponding to the Timing Gears(40)(41), are driven with the Timing Belt(90) in zigzag configuration, as illustrated in the FIG. 5(*b*) and FIG. 7(*a*). As shown in the FIG. 5(*d*), the said Rollers(80)(81) are arranged in three rows with three rollers in each row and surface-contacted with the Timing Belt(90).

The said Timing Belt(90), as shown in the FIGS. 4(*d*), 5(*d*), 6(*d*) and 7(*a*), reeves through the Timing Gear(40) and Roller (80) and Timing Gear(41) and Roller(81) in zigzagged configuration, and whose both ends are connected to the top of the Front and Rear Fixed Frames(31)(32), respectively, engages with the teeth of the Timing Gears(40)(41) with its grooves and surface-contacts with the Rollers(80)(81). Since the Timing Belt(90) connects the multiple Timing Gears(40) (41) and Rollers(80)(81), it drives the Timing Gears(40)(41) and Rollers(80)(81) simultaneously.

The said Timing Belt(90) in accordance with the present invention, as illustrated in the FIG. 7(*a*) reeves through; the third the Roller(80)→third Timing Gear(40)→second Roller (80)→second Timing Gear(40)→first Roller(80)→first Timing Gear(40)→first Timing Gear(41)→first Roller(81)→second Timing Gear(41)→second Roller(81)→third Timing Gear(41)→third Roller(81), in zigzagged configuration. Here, the third Rollers(80)(81) refer to those at the upper part of the said Forward and Backward Movement Frames(60) (70), the third Timing Gears(40)(41) refer to those at the upper part of the Front and Rear Fixed Frames(31)(32), the second Rollers(80)(81) refer to those at the middle part of the said Forward and Backward Movement Frames(60)(70), the second Timing Gears(40)(41) refer to those at the middle part of the Front and Rear Fixed Frames(31)(32), the first Rollers (80)(81) refer to those at the lower part of the said Forward and Backward Movement Frames(60)(70), and the first Timing Gears(40)(41) refer to those at the lower part of the Front and Rear Fixed Frames(31)(32).

The said Electric Motor(100) which drives the Connecting Shat(50) in forward and reverse directions, as shown in the FIGS. 4(*b*) and 4(*c*), is bolt jointed on one side of the Bed(10), installed with a drive pulley(P2) on its shaft, and the drive pulley(P2) and the said pulley(P1) of the said Connecting Shat(50) are connected with a belt(P3). Therefore, when the Electric Motor(100) operates in forward or reverse direction, the pulley(P1) is driven via the drive pulley(P2) and belt(P3), which in turn drives the first Timing Gears(40) on both sides via the Connecting Shat(50), and the second and third Timing Gears(40)(41) and the first, second, and third Rollers(80) (81).

The mechanism of the entire drive chain system in accordance with the present invention, set forth and described hereinabove, is described in detail hereinbelow.

Referring to the FIG. 7(*b*), when the shaft of the Electric Motor(100) is driven in reverse(clockwise) direction, the pulley(P1) on the Connecting Shat(50) is driven clockwise via the drive pulley(P2) and belt(P3), which in turn drives the first Timing Gears(40) on both sides clockwise via the Connecting Shat(50).

When the first Timing Gear(40) rotates clockwise, the second and third Timing Gears(40) on the front side and the first, second, and third Timing Gears(40) on the rear side are driven clockwise simultaneously, while driving the first, second, and third Rollers(80)(81) on the front and rear sides are driven counterclockwise. In this case of operation, as the Timing Belt(90) operates as illustrated in the FIG. 7(*b*), the first, second, and third Rollers(80)(81) are moved backward together. When the Timing Gears(40)(41) and Rollers(80)(81) move backward, as illustrated in the FIG. 7(*b*), the length of the Timing Belt(90) contacting the front Timing Gear(40) and Roller(80) is extended, while the length of the Timing Belt(90) contacting the rear Timing Gear(41) and Roller(81) is shortened.

When the Rollers(80)(81) are moved backward simultaneously by the Timing Belt(90), as described above, the Forward and Backward Movement Frames(60)(70) which support the Rollers(80)(81) are moved backward, too, which in turn moves the Main Body(20) connected with the Forward and Backward Movement Frames(60)(70) backward along on the Rails(11) on both sides of the Base(10).

Referring to the FIG. 7(*c*), when the shaft of the Electric Motor(100) is driven in forward(counterclockwise) direction, the pulley(P1) on the Connecting Shat(50) is driven counterclockwise via the drive pulley(P2) and belt(P3), which in turn drives the first Timing Gears(40) on both sides clockwise via the Connecting Shat(50).

When the first Timing Gear(40) rotates counterclockwise, the second and third Timing Gears(40) on the front side and the first, second, and third Timing Gears(40) on the rear side are driven counterclockwise simultaneously, while driving the first, second, and third Rollers(80)(81) on the front and rear sides are driven clockwise. In this case of operation, as the Timing Belt(90) operates as illustrated in the FIG. 7(*c*), the first, second, and third Rollers(80)(81) are moved forward together. When the Timing Gears(40)(41) and Rollers(80)(81) move forward, as illustrated in the FIG. 7(*c*), the length of the Timing Belt(90) contacting the front Timing Gear(40) and Roller(80) is shortened, while the length of the Timing Belt(90) contacting the rear Timing Gear(41) and Roller(81) is extended.

When the Rollers(80)(81) are moved forward simultaneously by the Timing Belt(90), as described above, the Forward and Backward Movement Frames(60)(70) which support the Rollers(80)(81) are moved forward, too, which in turn moves the Main Body(20) connected with the Forward and Backward Movement Frames(60)(70) forward along on the Rails(11) on both sides of the Base(10).

As described hereinabove referring to the drawings, the Main Body(20) of a sewing machine can be moved forward or backward by the connected Forward and Backward Movement Frames(60)(70) by the forward and backward rotation control of Electric Motor(100).

As described hereinabove, the apparatus for the forward and backward drive of the main body of sewing machine in accordance with the present invention can drive main body forward and backward using timing gears, forward and backward movement frame, rollers and timing belt, which replace the screw and screw bearings of conventional sewing machine drive chain, more smoothly and precisely, at higher speed.

In addition, as described hereinabove, the apparatus for the forward and backward drive of the main body of sewing machine in accordance with the present invention can drive main body forward and backward more smoothly and precisely, at higher speed, the productivity and quality of products can be improved.

In addition, the apparatus for the forward and backward drive of the main body of sewing machine in accordance with the present invention can protect the machine parts from being damaged by operational load, because the force of the load is distributed to the Timing Belt(90), Timing Gears(40)(41) and Rollers(80)(810).

In addition, the apparatus for the forward and backward drive of the main body of sewing machine in accordance with the present invention can reduce the cost of machine by replacing the costly parts, such as screws and screw bearings, of conventional machines with cheaper parts.

What is claimed is:

1. An apparatus for the forward and backward drive of the main body of sewing machine, which employs a main Body(20) movable forward and backward on a Base(10) and a needle Head(H) movable left and right on the Main Body(20), comprising; the Frame(30) mounted on both sides of the Base(10); the Timing Gears(40)(41) installed in the front and rear Fixed Frames(31)(32) of the Frame(30) in multiple rows; a Connecting Shat(50) which connects the Timing Gears(40)(41) beneath the Front Fixed Frame(31); the Forward and Backward Movement Frames(60)(70) which is movable forward and backward on the Frame(30) and connected to the Main Body(20); the Rollers(80)(81) which are installed in the Forward and Backward Movement Frames(60)(70) in multiple rows to correspond to the Timing Gears(40)(41); a Timing Belt(90) which zigzags through the Timing Gear(40) and Roller(80) and Timing Gear(41) and Roller(81), and the both ends of which are connected to the top of the Front and Rear fixed Frames(31)(32); and an electric motor(100) which drives the Connecting Shat(50) in forward and reverse directions.

2. The apparatus for the forward and backward drive of the main body of sewing machine in accordance with the claim 1, wherein on the both sides of the top of the said Base(10) are installed with Rails(11), on the both sides of the bottom of the said Main Body(20) are installed with Brackets(21) which are installed with the Sliders(22) assembled with the Rails(11) at the bottom and mounted with the said Forward and Backward Movement Frames(60)(70) on top.

3. The apparatus for the forward and backward drive of the main body of sewing machine in accordance with the claim 2, wherein the said Forward Movement Frame(60) is formed with a long hole(61) on its bottom for bolt jointing with the said Bracket(21) to allow position adjustment, and the said Forward and Backward Movement Frames(60)(70) has a tension adjustment bolt(B2) for adjusting the tension of the said Timing Belt(90), and the said Forward Movement Frame(60) is formed with a fix nut(N1) which joint the tension adjustment bolt(B2), and this tension adjustment bolt(B2) is provided with a tightening nut(N2).

4. The apparatus for the forward and backward drive of the main body of sewing machine in accordance with the claim 1, wherein the said Timing Gears(40)(41) and Rollers(80)(81) are arranged in three rows.

5. The apparatus for the forward and backward drive of the main body of sewing machine in accordance with claim 1, wherein the teeth of the said Timing Gears(40)(41) are engaged with the grooves on the Timing Belt(90) and the said Rollers(80)(81) contact with the Timing Belt(90) by surface-to-surface.

6. The apparatus for the forward and backward drive of the main body of sewing machine in accordance with the claim 1, wherein the said Connecting Shat(50) is installed with a driven pulley(P1), the said Electric Motor(100) is installed with a driving pulley(P2), and the driven pulley(P1) and the driving pulley(P2) are connected with one or more belts(P3).

* * * * *